US011442402B2

(12) United States Patent
Josiah et al.

(10) Patent No.: US 11,442,402 B2
(45) Date of Patent: Sep. 13, 2022

(54) METHOD AND SYSTEM FOR CONVERTING A TONER CARTRIDGE PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 0 days.

(21) Appl. No.: 17/331,412

(22) Filed: May 26, 2021

(65) Prior Publication Data

US 2021/0286292 A1 Sep. 16, 2021

Related U.S. Application Data

(63) Continuation of application No. 17/194,620, filed on Mar. 8, 2021, which is a continuation-in-part of application No. 17/079,151, filed on Oct. 23, 2020, now Pat. No. 11,409,207, which is a continuation-in-part of application No. 16/402,718, filed on May 3, 2019, now abandoned, which is a continuation-in-part of application No. 15/800,482, filed on Nov. 1, 2017, now Pat. No. 10,310,446, and (Continued)

(51) Int. Cl.

| | |
|---|---|
| ***G03G 21/18*** | (2006.01) |
| ***G03G 15/08*** | (2006.01) |
| ***G03G 15/01*** | (2006.01) |
| ***G03G 15/00*** | (2006.01) |

(52) U.S. Cl.

CPC ..... *G03G 21/181* (2013.01); *G03G 15/0121* (2013.01); *G03G 15/0863* (2013.01); *G03G 15/0877* (2013.01); *G03G 15/6585* (2013.01); *G03G 15/0178* (2013.01)

(58) Field of Classification Search

CPC ..... G03G 15/6585; G03G 15/0121; G03G 15/0894; G03G 15/0178; G03G 15/5087

See application file for complete search history.

(56) References Cited

U.S. PATENT DOCUMENTS

2003/0165766 A1* 9/2003 Zhang ..... G03G 9/08764 430/108.1

2007/0030500 A1* 2/2007 Otake ..... H04N 1/2369 358/1.9

(Continued)

*Primary Examiner* — Jessica L Eley

(74) *Attorney, Agent, or Firm* — Kevin Schraven; Anooj Patel; Hankin Patent Law, APC

(57) ABSTRACT

A method of converting a CMYK toner printer to print with a white toner, comprising the steps: providing a CMYK toner printer; wherein the toner printer has four printing cartridges; wherein the four printing cartridges comprise a black toner printing cartridge, a cyan toner printing cartridge, a magenta toner printing cartridge, and a yellow toner printing cartridge; removing the black toner printing cartridge from the toner printer, such that there is an empty toner cartridge slot; providing a white toner printing cartridge that is filled with a white toner; installing the white toner printing cartridge into the empty toner cartridge slot; and providing raster image processor (RIP) software, such that the printer is able to incorporate the white toner into one or more images printed by the printer.

11 Claims, 8 Drawing Sheets

Related U.S. Application Data a continuation-in-part of application No. 15/722,562, filed on Oct. 2, 2017, now Pat. No. 10,324,395, said application No. 15/800,482 is a continuation-in-part of application No. 15/408,186, filed on Jan. 17, 2017, now Pat. No. 9,835,968, and a continuation-in-part of application No. 15/286,998, filed on Oct. 6, 2016, now Pat. No. 9,835,983, and a continuation-in-part of application No. 15/286,943, filed on Oct. 6, 2016, now Pat. No. 9,835,982, and a continuation-in-part of application No. 15/286,875, filed on Oct. 6, 2016, now Pat. No. 9,835,981, and a continuation-in-part of application No. 14/879,548, filed on Oct. 9, 2015, now Pat. No. 9,488,932, and a continuation-in-part of application No. 14/731,785, filed on Jun. 5, 2015, now Pat. No. 9,383,684, said application No. 16/402,718 is a continuation-in-part of application No. 15/994,750, filed on May 31, 2018, now Pat. No. 10,649,372, which is a continuation-in-part of application No. 15/722,503, filed on Oct. 2, 2017, now Pat. No. 10,228,637, and a continuation-in-part of application No. 15/800,482, filed on Nov. 1, 2017, now Pat. No. 10,310,446.

(60) Provisional application No. 62/470,639, filed on Mar. 13, 2017.

(56) References Cited

U.S. PATENT DOCUMENTS

| | | | | |
|---|---|---|---|---|
| 2008/0145071 | A1* | 6/2008 | Ogasawara | G03G 15/556 399/28 |
| 2010/0027040 | A1* | 2/2010 | Kuroda | G06F 3/1256 358/1.9 |
| 2014/0037307 | A1* | 2/2014 | Kuo | G03G 15/01 358/1.9 |
| 2014/0119779 | A1* | 5/2014 | Zaretsky | G03G 15/224 399/231 |

* cited by examiner

METHOD AND SYSTEM FOR CONVERTING A TONER CARTRIDGE PRINTER

CROSS-REFERENCE TO RELATED APPLICATIONS

This Patent Application is a Continuation of U.S. Non-Provisional patent application Ser. No. 15/944,750, titled Method And System For Converting A Toner Cartridge Printer, filed on May 31, 2018, now U.S. Pat. No. 10,649,372, the contents of which are expressly incorporated herein by this reference as though set forth in their entirety and to which priority is claimed. Priority to U.S. Non-Provisional patent application Ser. No. 15/944,750 is established by the following chain of title set forth hereinbelow. This Patent Application is a Continuation Application of U.S. Non-Provisional patent application Ser. No. 17/194,620, titled A Method For Converting A Toner Cartridge, filed on Mar. 8, 2021, the contents of which are expressly incorporated herein by this reference as though set forth in their entirety and to which priority is claimed. U.S. Non-Provisional patent application Ser. No. 17/194,620 is a Continuation-in-Part Application of U.S. Non-Provisional patent application Ser. No. 17/079,151, titled A Method For Converting A Toner Cartridge, filed on Oct. 23, 2020, the contents of which are expressly incorporated herein by this incorporated herein by this reference as though set forth in their entirety and to which priority is claimed. U.S. Non-Provisional patent application Ser. No. 17/079,151 is a Continuation-in-Part Application of U.S. Non-Provisional patent application Ser. No. 16/402,718, titled Method For Converting A Toner Cartridge Printer To A Security Toner Printer, filed on May 3, 2019, the contents of which are expressly incorporated herein by this incorporated herein by this reference as though set forth in their entirety and to which priority is claimed. U.S. Non-Provisional patent application Ser. No. 16/402,718 is a Continuation-in-Part Application of U.S. Non-Provisional patent application Ser. No. 15/800,482, titled Method For Converting A Toner Cartridge Printer To A Sublimation Toner Printer, filed on Nov. 1, 2017, now U.S. Pat. No. 10,310,446, the contents of which are expressly incorporated herein by this reference as though set forth in their entirety and to which priority is claimed. U.S. Non-Provisional patent application Ser. No. 15/800,482 takes priority from U.S. Provisional Patent Application No. 62/470,639, filed on Mar. 13, 2017, titled Toner Cartridge Printer Devices, Systems, and Methods, the contents of which are expressly incorporated herein by this reference as though set forth in their entirety and to which priority is claimed. U.S. Non-Provisional patent application Ser. No. 16/402,718 is also a Continuation-in-Part Application of U.S. Non-Provisional patent application Ser. No. 15/722,562, titled Toner Cartridge Printer Devices, Systems, And Methods For Under Printing, filed on Oct. 2, 2017, now U.S. Pat. No. 10,324,395, the contents of which are expressly incorporated herein by this reference as though set forth in their entirety and to which priority is claimed. U.S. Non-Provisional patent application Ser. No. 15/800,482, is a Continuation-in-Part of the following U.S. Non-Provisional Patent Application Nos., which means that this U.S. Patent Application is also a Continuation in Part of the following U.S. Non-Provisional Patent Application Nos.: (1) Ser. No. 15/408,186, filed on Jan. 17, 2017, titled, Toner Cartridge Printer Devices, Systems, and Methods For Over Printing and Under Printing, now U.S. Pat. No. 9,835,968; (2) Ser. No. 15/286,998, filed on Oct. 6, 2016, titled, Method and System for Converting a Toner Cartridge Printer to a Double White Toner Printer, now U.S. Pat. No. 9,835,983; (3) Ser. No. 15/286,943, filed on Oct. 6, 2016, titled Method And System For Converting A Toner Cartridge Printer To A White, Clear, Metallic, Fluorescent, Or Light Toner Printer, now U.S. Pat. No. 9,835,982; (4) Ser. No. 15/286,875, filed on Oct. 6, 2016, titled, Method and System for Converting a Toner Cartridge Printer to a Metallic, Clear Fluorescent, or Light Toner Printer, now U.S. Pat. No. 9,835,981; (5) Ser. No. 14/879,548, now U.S. Pat. No. 9,488,932, filed on Oct. 9, 2015, titled, Method and System for Converting a Toner Cartridge Printer to a White, Clear, or Fluorescent Toner Printer; (6) Ser. No. 14/731,785, now U.S. Pat. No. 9,383,684, filed on Jun. 5, 2015, titled, Method and System for Converting a Toner Cartridge Printer to a White Toner Printer; the contents of all of which are expressly incorporated herein by this reference as though set forth in their entirety and to which priority is claimed as Continuation-in-Part. U.S. Non-Provisional patent application Ser. No. 16/402,718 is also a Continuation-in-Part Application of U.S. Non-Provisional patent application Ser. No. 15/944,750, titled Method And System For Converting A Toner Cartridge Printer, filed on May 31, 2018, now U.S. Pat. No. 10,649,372, the contents of which are expressly incorporated herein by this reference as though set forth in their entirety and to which priority is claimed. U.S. Non-Provisional patent application Ser. No. 16/402,718 is also a Continuation-in-Part Application of U.S. Non-Provisional patent application Ser. No. 15/722,503, filed on Oct. 17, 2017, titled Method and System For Converting A Toner Cartridge Printer to a Metallic Or Light Toner Printer, now U.S. Pat. No. 10,229,637. U.S. Non-Provisional patent application Ser. No. 15/944,750, is a Continuation-in-Part of U.S. Non-Provisional patent application Ser. No. 15/722,503, filed on Oct. 17, 2017, titled Method And System For Converting A Toner Cartridge Printer To A Metallic Or Light Toner Printer, now U.S. Pat. No. 10,228,637.

FIELD OF USE

The present disclosure relates generally to printer cartridge replacement. More specifically, this disclosure relates to methods and systems of converting a standard toner cartridge printer to a printer that prints with at least one non-standard toner.

BACKGROUND

Traditional Cyan (C), Magenta (M), Yellow (Y), and Black (K) (or CMYK) laser or Light Emitting Diode (LED) type printers come standard with Cyan, Magenta, Yellow, and Black toner and/or drum cartridges. However, traditional black toner printers and CMYK toner printers are generally unable to be converted to print with toner other than cyan, magenta, yellow, and black, as these printers lack the appropriate toner and/or drum cartridges and the appropriate raster image processor (RIP) software for printing cartridge re-mapping.

Printing in white toner is feasible through the use of white toner printers and would generally allow a user to print on dark or clear media, but white media printers are dedicated to CMYW only where white is always a top color. This system does not allow printing on clear or dark media and may require the user to buy an entirely new printer. Printers that print both in white and color are CMYKW printers with a minimum of five toner printing cartridges and white is always the last cartridge.

Thus, there is a need for a system and method for converting a standard CMYK (four cartridge) toner printer to print using a non-standard color, such as white, clear, or clear fluorescent.

SUMMARY OF EMBODIMENTS

To minimize the limitations in the cited references, and to minimize other limitations that will become apparent upon reading and understanding the present specification, the toner printer converting, refilling, and refurbishment systems and methods disclosed herein preferably allow a user to convert a standard printer into one that prints using non-standard toner, including white, clear, clear fluorescent, fluorescent, metallic gold, metallic silver, light colors, ceramic toners, security toners, and sublimation toners.

In various embodiments, the methods and systems may be used to convert a traditional toner cartridge(s) and/or drum(s) printing machine to a printing machine that prints white, clear, and clear fluorescent.

In one embodiment, a standard toner cartridge printer is converted by replacing one of the standard color or black toner printing cartridges, from any slot, with a non-standard toner cartridge and then using raster image processing (RIP) software to match or set in which printer slot each of the cartridges resides.

In another embodiment, a standard toner cartridge printer is converted by replacing the color or black toner printing cartridge in the last toner printing cartridge position, which allows the printer to print white, metallic, or light as a foreground color. The RIP software allows a user to set how much non-standard toner should be added to maximize the look of the finished print job.

In one embodiment, the cartridge re-mapping is used to allow a white, clear, or non-standard toner printing cartridge to be put in the "K" (black) slot (which may be the first slot in the printer) of a CYMK printer and the CYM cartridges are all in their original slots. In this manner, a layer of non-standard toner may be put down, on top of which a full color layer may be printed, and may be used on clear and dark media.

In one embodiment the printing cartridge integrated circuits (chips) may be swapped along with the toner printing cartridges, and the RIP software is configured to ensure that the correct colors print regardless of which slot the colors are placed.

The RIP software may allow or feature color rasterization, which enables the printer to use less toner by selectively removing pixels to use less toner. This feature gives a nicer feel and ads more durability to the finished product.

One embodiment is a method of converting a CMYK toner printer to print with a non-standard toner, comprising the steps: providing a CMYK toner printer; wherein the toner printer has four printing cartridges; wherein the four printing cartridges comprise a black toner printing cartridge, a cyan toner printing cartridge, a magenta toner printing cartridge, and a yellow toner printing cartridge; removing the black toner printing cartridge from the toner printer, such that there is an empty toner cartridge slot; providing a non-standard toner printing cartridge that is filled with a non-standard toner; installing the non-standard toner printing cartridge into the empty toner cartridge slot; and providing raster image processor (RIP) software, such that the printer is able to incorporate the non-standard toner into one or more images printed by the printer. The RIP software allows for remapping of the printer. The RIP software allows black to be printed using a combination of cyan, magenta, and yellow (the amount of each may be set or determined by RIP; usually 50-80% of each color is used to create a rich black). The non-standard toner printing cartridge may be selected from the group of non-standard toner printing cartridges consisting of: white; clear; and clear fluorescent. The non-standard toner printing cartridge may be selected from the group of non-standard toner printing cartridges consisting of: white; clear; clear fluorescent; metallic, ceramic, sublimation, and security. The printer may be a laser toner printer or a LED toner printer.

Another embodiment may be a method of converting a CMYK toner printer to print with a white toner, comprising the steps: providing a CMYK toner printer; wherein the toner printer has four printing cartridges; wherein the four printing cartridges comprise a black toner printing cartridge, a cyan toner printing cartridge, a magenta toner printing cartridge, and a yellow toner printing cartridge; removing the black toner printing cartridge from the toner printer, such that there is an empty toner cartridge slot; providing a white toner printing cartridge that is filled with a white toner; installing the white toner printing cartridge into the empty toner cartridge slot; and providing raster image processor (RIP) software, such that the printer is able to incorporate the white toner into one or more images printed by the printer. The RIP software allows for remapping of the printer. The RIP software allows black to be printed using cyan, magenta, and yellow (the amount of each may be set or determined by RIP; usually 50-80% of each color is used to create a rich black). The printer may be a laser toner printer or a LED toner printer.

One embodiment may be a method of converting a printer to print with white toner, comprising the steps: providing a toner printer. The toner printer may have four printing cartridges and may comprise a black toner printing cartridge, a cyan toner printing cartridge, a magenta toner printing cartridge, and a yellow toner printing cartridge. The black toner printing cartridge may be in a first position of the toner printer. The black toner may be removed from the printing cartridge from the toner printer. A white toner printing cartridge may be provided. The white toner printing cartridge may be installed into the first position of the toner printer. A raster image processor (RIP) software may be provided for printing cartridge remapping such that a first layer using only the white toner printing cartridge may be printed, and then a second layer may be printed over the white layer in one pass. The printer may be a laser toner printer. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The installing of the white toner printing cartridge in the first position may allow the printer to print the first layer using only the white toner printing cartridge. Additionally, the provided white toner printing cartridge may comprise: disassembling the removed black toner printing cartridge; emptying and cleaning the removed black toner printing cartridge, such that an empty printing cartridge may be created; and filling the empty printing cartridge with a white toner.

Another embodiment may be a method of converting a printer to print with white toner, comprising the step: providing a toner printer. The toner printer may have four printing cartridges. The four printing cartridges may comprise a black toner printing cartridge, a cyan toner printing cartridge, a magenta toner printing cartridge, and a yellow toner printing cartridge. The black toner printing cartridge may be in a first position of the toner printer. The black toner printing cartridge may be removed from the toner printer. A cyan toner printing cartridge may be in a fourth position of the toner printer. The cyan toner printing cartridge may be removed from the toner printer. A white toner printing cartridge may be provided. A cyan toner printing cartridge may be installed into the first position of the toner printer. The white toner printing cartridge may be installed into the fourth position of the toner printer. Raster image processor (RIP) software may provide for printing cartridge remapping. A first layer not using the white toner printing cartridge may be printed, and then a second layer may be printed over the first layer. The second layer may print only using the white toner printing cartridge. A layer using all four of the four toner printing cartridges may be printed. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. Additionally, the provided white toner printing cartridge may comprise: disassembling the removed black toner printing cartridge; emptying and cleaning the removed black toner printing cartridge, such that an empty printing cartridge may be created; and filling the empty printing cartridge with a white toner.

Another embodiment of the method may be a method of converting a printer to print with clear fluorescent toner, comprising the steps: providing a toner printer; wherein the toner printer has four printing cartridges; wherein the four printing cartridges comprise a black toner printing cartridge, a cyan toner printing cartridge, a magenta toner printing cartridge, and a yellow toner printing cartridge; wherein the black toner printing cartridge is in a first position of the toner printer; removing the black toner printing cartridge from the toner printer; wherein the cyan toner printing cartridge is in a fourth position of the toner printer; removing the cyan toner printing cartridge from the toner printer; providing a clear fluorescent toner printing cartridge; installing the cyan toner printing cartridge into the first position of the toner printer; installing the clear fluorescent toner printing cartridge into the fourth position of the toner printer; providing raster image processor (RIP) software for printing cartridge remapping; and wherein the clear fluorescent toner is only visible under an ultraviolet light. The method may further comprise the steps: printing a first layer not using the clear toner printing cartridge and then printing a second layer over the first layer; wherein the second layer prints only using the clear fluorescent toner printing cartridge. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The providing of the clear fluorescent toner printing cartridge comprises: disassembling the removed black toner printing cartridge; emptying and cleaning the removed black toner printing cartridge, such that an empty printing cartridge is created; and filling the empty printing cartridge with a clear fluorescent toner.

Another embodiment of the method may be a method of converting a printer to print with white toner comprising the steps: providing a color toner printer; wherein the color toner printer comprises a plurality of drum cartridges and a plurality of toner cartridges; wherein the plurality of toner cartridges comprises a cyan toner cartridge, a yellow toner cartridge, a magenta toner cartridge, and a black toner cartridge; wherein the plurality of drum cartridges comprises a cyan drum cartridge, a yellow drum cartridge, a magenta drum cartridge, and a black drum cartridge; removing the cyan toner cartridge, the magenta toner cartridge, the cyan drum cartridge, and the magenta drum cartridge; disassembling the cyan drum cartridge and the magenta drum cartridge; emptying and cleaning the cyan toner cartridge, the magenta toner cartridge, the cyan drum cartridge, and the magenta drum cartridge; priming the cyan drum cartridge and the magenta drum cartridge with a white toner; filling the cyan toner cartridge and the magenta toner cartridge with the white toner; and installing the white toner filled cartridges and the white toner primed drums into the printer. The method may also comprise refurbishing at least one of the cyan toner cartridge, the magenta toner cartridge, the cyan drum cartridge, and the magenta drum cartridge. The method may also comprise disassembling at least one of the cyan toner cartridge and the magenta toner cartridge. The method may also comprise adjusting one or more printer settings so that the printer prints using the white toner filled cartridges. The one or more printer settings may be set to print 100% Cyan and 100% Magenta in order to print white areas.

Another embodiment of the method may be a method of converting a printer to print with white toner, comprising the steps: providing a color toner printer; wherein the color toner printer comprises a drum cartridge and a plurality of toner cartridges; wherein the plurality of toner cartridges comprises a cyan toner cartridge, a yellow toner cartridge, a magenta toner cartridge, and a black toner cartridge; removing the yellow toner cartridge, the magenta toner cartridge, and the drum cartridge; disassembling the drum cartridge; emptying and cleaning the cyan toner cartridge, the magenta toner cartridge, and the drum cartridge; priming the drum cartridge with a white toner; filling the cyan toner cartridge and the magenta toner cartridge with the white toner; and installing the white toner filled cartridges and the white toner primed drum into the printer. The method may further comprise refurbishing at least one of the cyan toner cartridge, the magenta toner cartridge, and the drum cartridge. The method may further comprise disassembling at least one of the cyan toner cartridge and the magenta toner cartridge. The method may further comprise adjusting one or more printer settings so that the printer prints using the white toner filled cartridges. The one or more printer settings may be set to print 100% Cyan and 100% Magenta in order to print white areas.

Another embodiment of the method may be a method of converting a printer to print with a non-standard toner, comprising the steps: providing a color toner printer; wherein the color toner printer comprises a plurality of drum cartridges and a plurality of toner cartridges; wherein the plurality of toner cartridges comprises a cyan toner cartridge, a yellow toner cartridge, a magenta toner cartridge, and a black toner cartridge; wherein the plurality of drum cartridges comprises a cyan drum cartridge, a yellow drum cartridge, a magenta drum cartridge, and a black drum cartridge; removing the black toner cartridge and the black drum cartridge; providing an empty replacement toner cartridge and an empty replacement drum cartridge; priming the empty replacement drum cartridge with a non-standard toner; filling the empty replacement toner cartridge with the non-standard toner; and installing the non-standard toner filled replacement toner cartridge and the non-standard toner primed drum cartridge into the printer. The empty replacement toner cartridge and the empty replacement drum cartridges may be new. The method may further comprise adjusting one or more printer settings so that the printer prints using the non-standard toner filled cartridge. The one or more printer settings may be set to print at 100% K. The non-standard toner may be selected from the group of non-standard toners consisting of: white, clear, metallic, and light toner.

Another embodiment may be a method of converting a CMYK printer to print with a non-standard toner, comprising the steps: providing a CMYK toner printer; wherein the CMYK toner printer has four toner printing cartridges, wherein three of the four toner printing cartridges are color printing cartridges comprising a cyan toner printing cartridge, a magenta toner printing cartridge, and a yellow toner printing cartridge; removing one or more of the color toner printing cartridges from the toner printer, such that there are one or more empty toner printing cartridge positions; providing one or more non-standard toner printing cartridges; and installing the one or more non-standard toner printing cartridges into the one or more empty toner printing cartridges. The one or more printer settings may be set to print at 100% K for printing in black. The non-standard toner in the one or more non-standard toner printing cartridges may be selected from the group of non-standard toners consisting of: metallic toner, and light toner. All three of the one or more of the color toner printing cartridges may be removed from the toner printer. The method may further comprise providing raster image processor (RIP) software for printing cartridge remapping. The method may further comprise adjusting one or more printer settings so that the printer prints using the one or more non-standard toner filled cartridges. The one or more non-standard toner printing cartridges may be the one or more removed color toner printing cartridges that have been emptied, cleaned, and refilled with at least one of a plurality of non-standard toners. The providing of the one or more non-standard toner printing cartridge may comprise: disassembling the removed one or more of the color toner printing cartridges; emptying and cleaning the removed one or more of the color toner printing cartridges, such that one or more empty printing cartridges are created; and filling the one or more empty printing cartridges with one of a plurality of non-standard toner.

It is an object of the present system and method for converting a standard toner cartridge printer into a printer that has at least one non-standard printing cartridge printer that has at least one non-standard printing cartridge.

It is an object of the present system to overcome the limitations of the prior art.

It is an object of the present system and method for raster image processor software to provide cartridge remapping, which allows the system to print using a non-standard toner from different cartridge positions.

One embodiment of the system and method may be a Double White Printing:

1. CMYK printer with separate toner and drum cartridges—white for magenta and cyan swap Turn off yellow Print white through red (½ cyan and ½ magenta (up to 100% of each, the amount of each may be set or determined by RIP; usually 50-80% of each color is used to create a rich double white white)), which preferably results in double white printing.

One embodiment of the system and method may be Double White Printing:

1. CMYK printer with a single drum and separate toner cartridges—white for magenta and cyan swap Turn off yellow Print white through red (½ cyan and ½ magenta (up to a 100% of each, the amount of each may be set or determined by RIP; usually 50-80% of each color is used to create a rich white)), which preferably results in double white printing.

In one embodiment of the system and method may use new empty or recycled empty toner cartridges that have been pre-cleaned and filed with a non-standard toner. In this embodiment the original cartridge(s) that are removed do not have to be cleaned and filed, they can immediately be replaced by a prefilled new or used cartridge.

Other features and advantages inherent in the system and method for converting a standard toner cartridge printer into white, metallic, or light toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
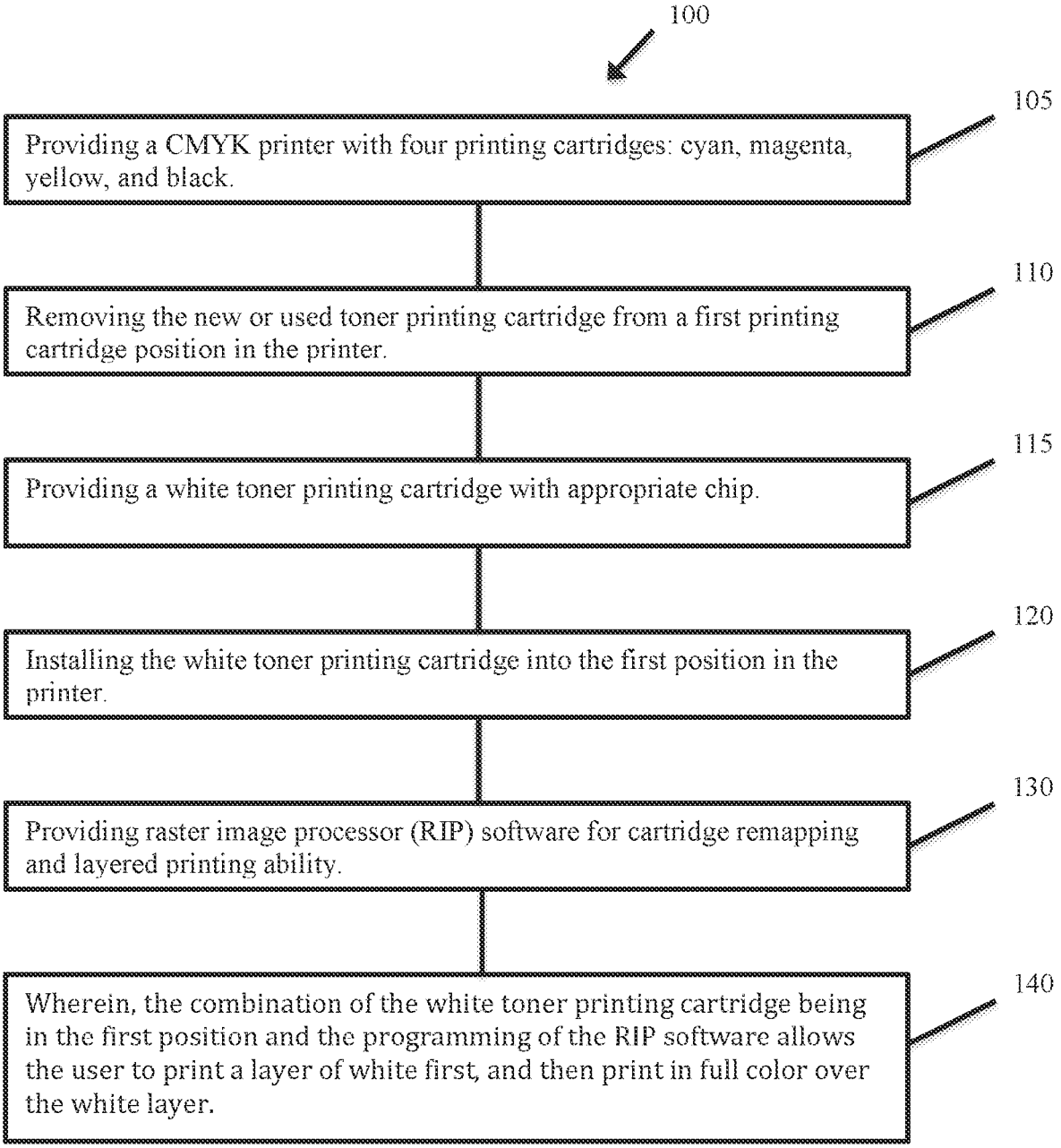
FIG. 1 is a flow block diagram of one embodiment of the method of converting a CMYK printer to print white in the background.

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYK printer, the letter "K" preferably stands for black.

Regarding a CMYKW printer, the letter "W" preferably stands for white, but may also refer to a non-standard toner or toner color, such as white, clear, clear fluorescent, and/or metallic.

Regarding a CMYKX printer, the letter "X" refers to a non-standard toner or toner color, such as white, metallic, fluorescent, light, clear, clear fluorescent, ceramic, and/or sublimation.

The term transfer material may typically refer to a polyurethane media that accepts the toner print job and then allows the print job to be transferred to a final print surface via heat transfer. The transfer material may also be constructed from any suitable material, such as a specially coated paper or even just plain paper. The final print surface is preferably plastic or polymer, such as, for example, a polyester shirt or product.

The present specification discloses a system and method for converting a toner cartridge printer to a non-standard toner printer. The method and system for converting a toner cartridge printer to a non-standard toner printer preferably requires no special or dedicated printer drivers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

The present method and system for converting a toner cartridge printer to a white, metallic, or light toner printer may allow the conversion of: (1) a conversion of a CMYK machine that has separate toner and drum cartridges; (2) a conversion of a CMYK machine that has separate toner and drum cartridges; and (3) a conversion of a CMYK machine with a single drum and separate toner printing cartridges.

Regarding the conversion of a CMYK machine that has separate toner and drum cartridges, the conversion may comprise replacing one of the color cartridges with a non-standard toner printing cartridge and replacing the accompanying color drum with a non-standard drum.

Regarding the conversion of a CMYK machine that has separate toner printing cartridges, but a single drum cartridge, the conversion may comprise replacing one of the standard cartridges with a non-standard toner printing cartridge and cleaning the accompanying drum portion of the standard toner and priming it with non-standard toner.

FIG. 1 is a flow block diagram of one embodiment of the method of converting a CMYK printer to print with white toner in the background. As shown in FIG. 1, the conversion method 100 may comprise providing a CMYK printer with four printing cartridges: cyan, magenta, yellow, and black 105. Preferably, the CMYK printer is a LED printer. In one embodiment the black toner printing cartridge may be in the first printing cartridge position. The method 100 may further comprise removing the black printing cartridge and/or drum cartridge from the printer 110. If there is only one drum cartridge that services all of the printing cartridges, the drum must be cleaned and primed with the clear or white toner. The method 100 may further comprise: providing a white toner printing cartridge and/or drum cartridge 115; installing the white toner and/or drum cartridge into the first slot or position in the CMYK printer 120; and providing raster image processor (RIP) software for printing cartridge remapping 130. Wherein, the combination of the white toner printing cartridge being in the first position and the programming of the RIP software allows the user to print a layer of white first, and then print in full color over the white layer 140. The white toner printing cartridge may be provided by disassembling the removed printing cartridge, emptying and cleaning the removed printing cartridge to create an empty printing cartridge, and then filling the empty printing cartridge with a white toner.

The installation may be of a used or new toner printing cartridge.

Regarding the RIP software, the RIP software utilizes printing cartridge mapping to enable the ability to move, change or swap printing cartridge locations in the printer. This allows white under printing or over printing in a single pass. The RIP software may also add a customizable separate layer of white either on top or underneath the image depending on the cartridge configuration and printing needs. This fully customizable feature in the software (RIP) allows you to completely reconfigure the printer to get almost any desired effect. However, in a preferred embodiment, the white toner background layer may be printed when the white toner is placed in the first printing cartridge position. Additionally, in a preferred embodiment, the white toner foreground layer may be printed when the white toner is place in the last printing cartridge position.

The RIP software may also be configured to allow the user to print in full color, CMY black, and white, such that the white prints with the other colors at the same time in a single layer. Preferably, the single layer is put down in a single pass.

The modified printer may be converted back to a traditional CMYK printer by removing the white toner and/or drum cartridge from the first slot in the CMYK printer and re-installing the black toner printing cartridge and/or drum cartridge (if needed).

Figure 2:
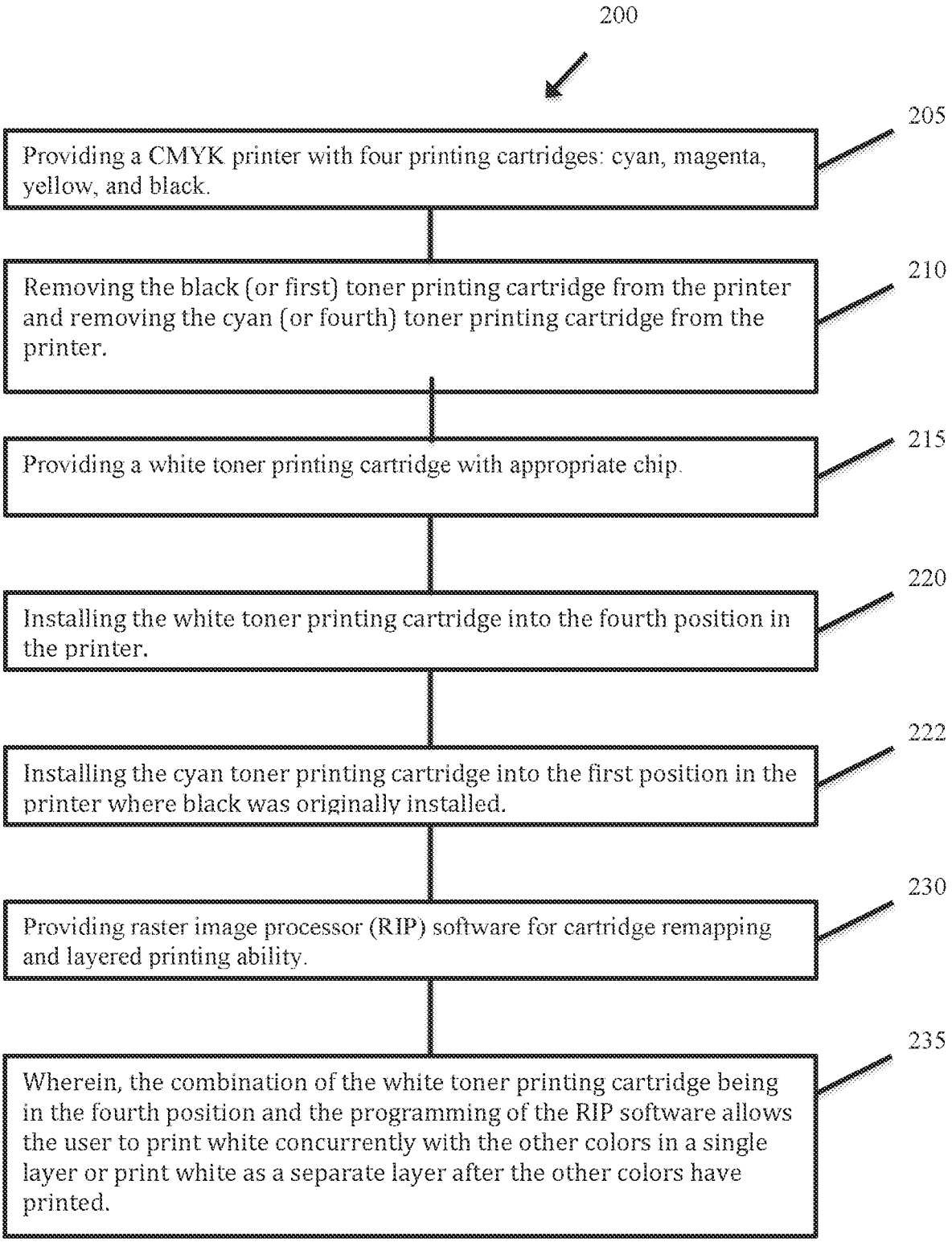
FIG. 2 is a flow block diagram of one embodiment of the method of converting a CMYK printer to print white in the foreground.

FIG. 2 is a flow block diagram of another embodiment of the method of converting a CMYK printer to print with white toner in the foreground. As shown in FIG. 2, the conversion method 200 may comprise providing a CMYK printer with four printing cartridges: cyan, magenta, yellow, and black 205. In one embodiment, the black toner printing cartridge may be in the first printing cartridge position and the cyan toner printing cartridge may be in the fourth printing cartridge position. With the white toner cartridge in the first or last slot the other color positions do not matter as long as they are mapped properly. For printing white in the foreground the white toner printing cartridge is preferably in the fourth position. The method 200 may further comprise removing the black toner printing cartridge and/or drum cartridge from the printer and removing the cyan toner printing cartridge from the printer 210. If there is only one drum cartridge that services all of the printing cartridges, the drum must be cleaned and primed with the appropriate clear, white, or cyan toner at the appropriate location on the drum. The method 200 may further comprise: providing a white toner printing cartridge and/or drum cartridge 215; installing the white toner printing cartridge and/or drum cartridge into the fourth slot or position in the printer 220, which previously housed the cyan toner printing cartridge; installing the cyan toner printing cartridge and/or drum cartridge into the first slot or position in the printer 222, which previously housed the black printing cartridge; and providing raster image processor (RIP) software for printing cartridge remapping 230. Wherein, the combination of the white toner printing cartridge being in the fourth position and the programming of the RIP software allows the user to print white concurrently with the other colors in a single layer or print white as a separate layer after the other colors have printed 235. The white toner printing cartridge may be provided by disassembling the black removed printing cartridge, emptying and cleaning the black removed printing cartridge to create an empty printing cartridge, and then filling the empty printing cartridge with a white toner.

This method may also be used to create spot color white cartridges. When white is printed as a separate layer after the other colors have printed, spot white may be printed around the first layer to produce white as a finished color. Traditional printers without specialized software take all white colors as a "page is white" and ignore the request to print in white. Traditional printers consider anything white as the color of the paper and do not print anything in the white areas. When a user creates a spot white color in a graphic to be printed, the present printer RIP software recognizes this as a printable color and prints using pure white toner.

The modified printer may be converted back to a traditional CMYK printer by removing the white and cyan toner printing cartridges and/or drum cartridges from the fourth and first slots in the CMYK printer and re-installing the cyan and black toner printing cartridges and/or drum cartridge into their original positions.

Figure 3:
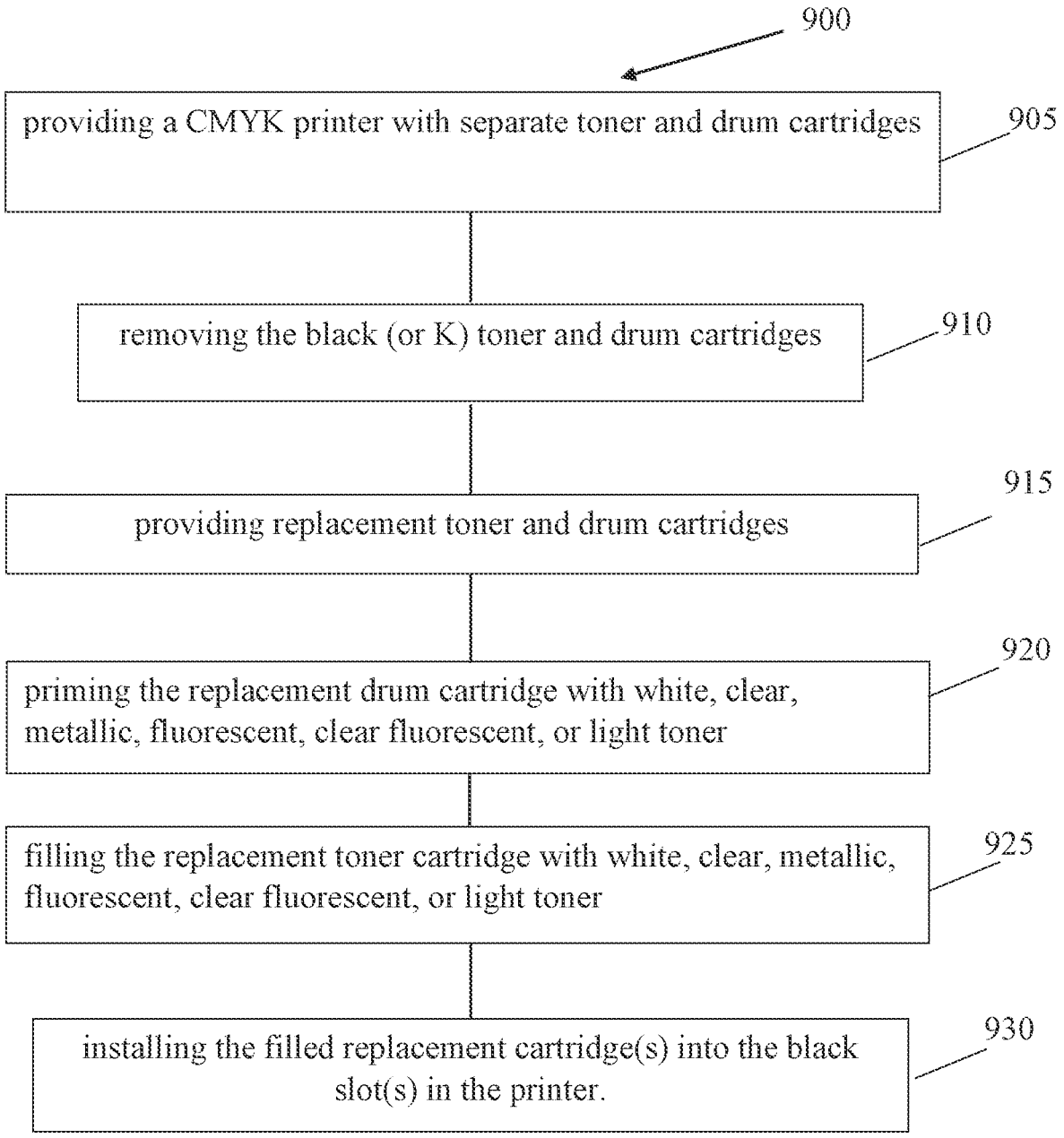
FIG. 3 is a flow block diagram of one embodiment of the method of converting a printer to print with white, clear, or clear fluorescent, with a single cartridge conversion.

FIG. 3 is a flow block diagram of one embodiment of the method of converting a printer to print with a non-standard toner, such as white, clear, metallic, fluorescent, clear fluorescent, or light toner. FIG. 9 shows that the single printer cartridge conversion method 900 may comprise the steps: 905, 910, 915, 920, 925, and 930. Step 905 may be providing a CMYK printer with separate toner and drum cartridges. The method 900 may also be used with a CMYK printer, wherein each toner cartridge has a built in drum. The next step 910 may be removing the black (or K) toner and/or drum cartridges from the printer. The next step is to provide aftermarket empty cartridges (toner and/or drum), referred to as replacement toner and/or drum cartridges 915. These replacement cartridges may be new or recycled/repaired/refurbished. If the drum cartridges are separate, they may be primed with white, clear, metallic, fluorescent, clear fluorescent, or light toner powder 920. Step 925 may be filling the toner cartridge with white, clear, metallic, fluorescent, clear fluorescent, or light toner. Step 930 may be installing the filled and primed replacement cartridges into the black (K) slot(s) in the printer.

Generally, the clear fluorescent toner that is only visible under ultraviolet (UV) light.

The double printing cartridges conversion may be desirable when more than one single pass of white may be needed to get optimum coverage. This is especially true for textured media. Additionally, for clear media, it may be desirable to be able to print in pure black using black toner in the K cartridge. The double printing cartridges conversion may comprise the steps: providing a CMYK printer with separate toner and drum cartridges; removing the cyan and magenta drum and toner cartridges; emptying the cartridges of toner; disassembling and cleaning the cartridges (if used and necessary); refurbishing and repairing the cartridges; reassembling the cartridges (if separate); priming the drum cartridges with white toner powder; filling both toner cartridges with white toner; and installing the refilled and/or refurbished cartridges into the cyan and magenta slots of the printer. White may be printed by setting the text or picture color to magenta or cyan. Since one of the purposes of the double cartridge conversion may be to provide double white toner coverage for textured or clear media, the user may select a color that uses equal parts magenta and cyan. 100% Magenta and 100% Cyan is an example of where anything printed will have a pass of white from the former magenta cartridge and a pass from the former cyan cartridge. The black and yellow cartridges may have been left intact, which generally means that the image may print in black, yellow, white, and double white. The preferred color setting for the brightest whites may be as follows:

Hexidecimal: 0000ff

RGB: 255

CMYK: C: 100%, M: 100% Y: 0% K: 0%

Pantone: No exact colors match. There are 11 colors or more that are close but not exact.

Regarding an LED printer, an extra step may be performed to block the yellow from printing, so that what remains may be to have a true black and double white printer without any possibility of any color (yellow) printing. By placing a cover over the LED slot of the drum unit of the yellow, this will preferably effectively block the yellow from printing and will not generate a printer error. Some yellow toner may need to be in the drum unit for lubrication, but this lubrication amount is preferably not enough to be used for or effect the printing.

If converting a laser printer, the yellow laser slot of the drum unit may not be blocked as the printer will likely produce an error message and will not print. Because yellow color toner may be in the drum, care should be taken to avoid the yellow bleeding into the image.

Aside from printing in white, the modified printer may also print in black when black printing is set to pure 100% K. The printer can be brought back to standard CMYK printing by installing traditional magenta and cyan cartridge sets, and, if necessary, removing the LED blocking bar for the yellow on LED machines. Various embodiments of the retrofitted printer may be a CMYKB printer, wherein the B is black and K is a toner other than basic black.

Figure 4:
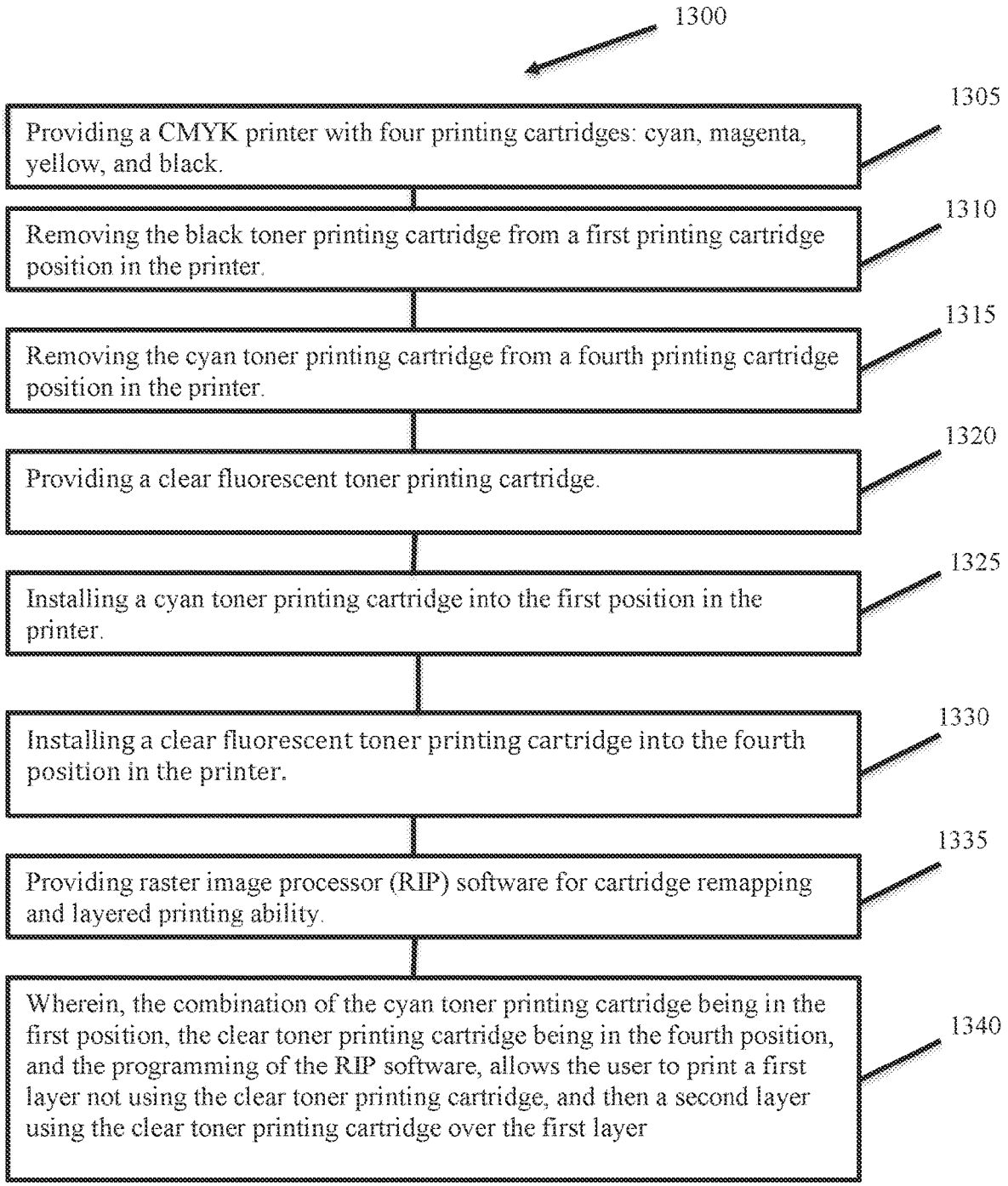
FIG. 4 is a flow block diagram of another embodiment of the method of converting a CMYK printer to print with fluorescent clear toner that is only visible under an ultraviolet light.

FIG. 4 is a flow block diagram of another embodiment of the method of converting a CMYK printer to print with clear fluorescent toner that is only visible under ultraviolet (UV) light. As shown in FIG. 13, one embodiment of the conversion method 1300 may comprise providing a CMYK printer with four printing cartridges: cyan, magenta, yellow, and black 1305. In one embodiment, the black toner printing cartridge may be in the first printing cartridge position and the cyan toner printing cartridge may be in the fourth printing cartridge position. With a clear fluorescent toner printing cartridge in the first or last slot, the other color positions do not matter as long as they are mapped properly. For printing clear as a second layer, the clear fluorescent toner printing cartridge is preferably in the fourth position. The method 1300 may further comprise removing the black (or first) toner printing cartridge and/or drum cartridge from the printer and removing the cyan (or fourth) toner printing cartridge from the printer 1310, 1315. If there is only one drum cartridge that services all of the printing cartridges, the drum must be cleaned and primed with the appropriate clear fluorescent toner or cyan toner at the appropriate location on the drum. The method 1300 may further comprise: providing a clear fluorescent toner printing cartridge and/or drum cartridge 1320; installing the clear fluorescent toner printing cartridge and/or drum cartridge into the fourth slot or position in the printer 1330, which previously housed the cyan toner printing cartridge; installing the cyan toner printing cartridge and/or drum cartridge into the first slot or position in the printer 1325, which previously housed the black printing cartridge; and providing raster image processor (RIP) software for printing cartridge remapping and layered printing ability 1335. Wherein, the combination of the clear fluorescent toner printing cartridge being in the fourth position and the programming of the RIP software, allows the user to print clear fluorescent concurrently with the other colors in a single layer or print clear fluorescent as a separate layer after the other colors have printed 1340. The clear fluorescent toner printing cartridge preferably has the appropriate chip. The clear fluorescent toner printing cartridge may be provided by disassembling the black removed printing cartridge, emptying and cleaning the black removed printing cartridge to create an empty printing cartridge, and then filling the empty printing cartridge with a fluorescent toner toner. Alternatively, the clear toner printing cartridge may be new and unused or used and refurbished.

The modified printer may be converted back to a traditional CMYK printer by removing the fluorescent toner and cyan toner printing cartridges and/or drum cartridges from the fourth and first slots in the CMYK printer and re-installing the cyan and black toner printing cartridges and/or drum cartridge into their original positions.

In one embodiment, a CMYK printer, such as a CMYW or CMYB printer, may be altered to feature any combination of clear fluorescent or standard colors.

Figure 5:
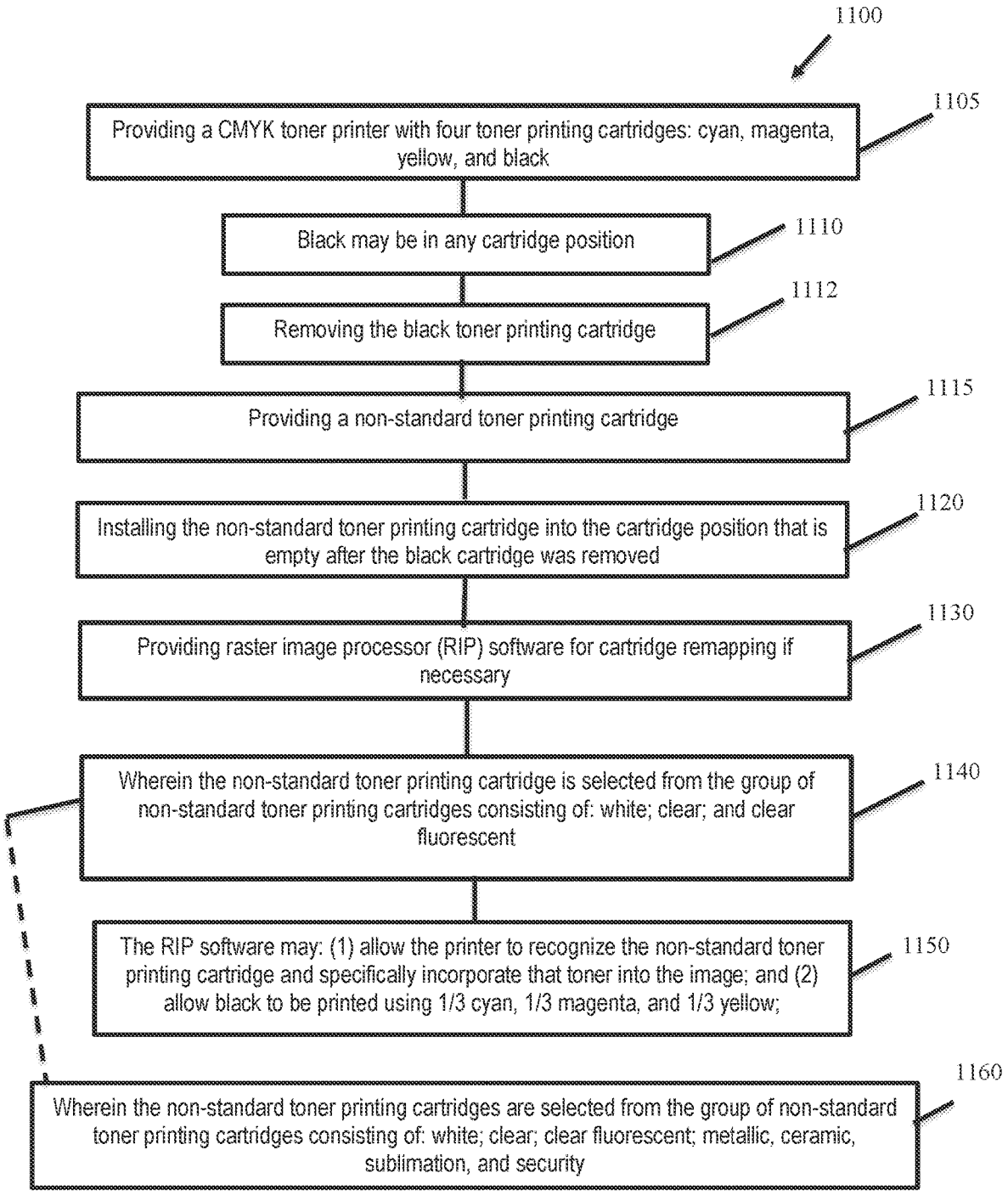
FIG. 5 is a flow block diagram of one embodiment of the method of converting a standard CMYK toner printer to print with a non-standard toner with a single cartridge conversion.

FIG. 5 is a flow block diagram of one embodiment of the method of converting a standard CMYK toner printer to print with a non-standard toner with a single cartridge conversion. FIG. 5 shows that the method 1100 may comprise the steps: providing a CMYK toner printer with four toner printing cartridges, cyan (C), magenta (M), yellow (Y), and black (K) 1105; the cartridges may be in any order and the black cartridge may be in any position 1110; removing the black toner printing cartridge 1112; providing a non-standard toner printing cartridge 1115; installing the non-standard toner printing cartridge into the cartridge position that is empty after the black cartridge was removed 1120; providing raster image processor (RIP) software for cartridge remapping if necessary 1130; wherein the non-standard toner printing cartridges are selected from the group of non-standard toner printing cartridges consisting of: white; clear; and clear fluorescent 1140; the RIP software may: (1) allow the printer to recognize the non-standard toner printing cartridge and specifically incorporate that toner into the image; and (2) allow black to be printed using cyan, magenta, and yellow 1150 (the amount of each may be set or determined by RIP; usually 50-80% of each color is used to create a rich black); and; wherein the non-standard toner printing cartridges are selected from the group of non-standard toner printing cartridges consisting of: white; clear; clear fluorescent; metallic, ceramic, sublimation, and security 1160. The non-standard toner may have a chip that allows the printer to recognize that the non-standard toner has replaced the black cartridge, so that RIP software may automatically set black to print using each of the color toners and automatically recognize what non-standard color has been put into the printer to replace the black toner cartridge. In other embodiments, the user may manually enter into the RIP software what non-standard toner was inserted into the printer. The RIP software is configured to allow the printer to print images that incorporate the non-standard toner. In some embodiments, the user may move around the three color toners after taking out the black toner. The non-standard toner is then inserted into the empty slot and the RIP software is used to remap the printer.

Figure 6:
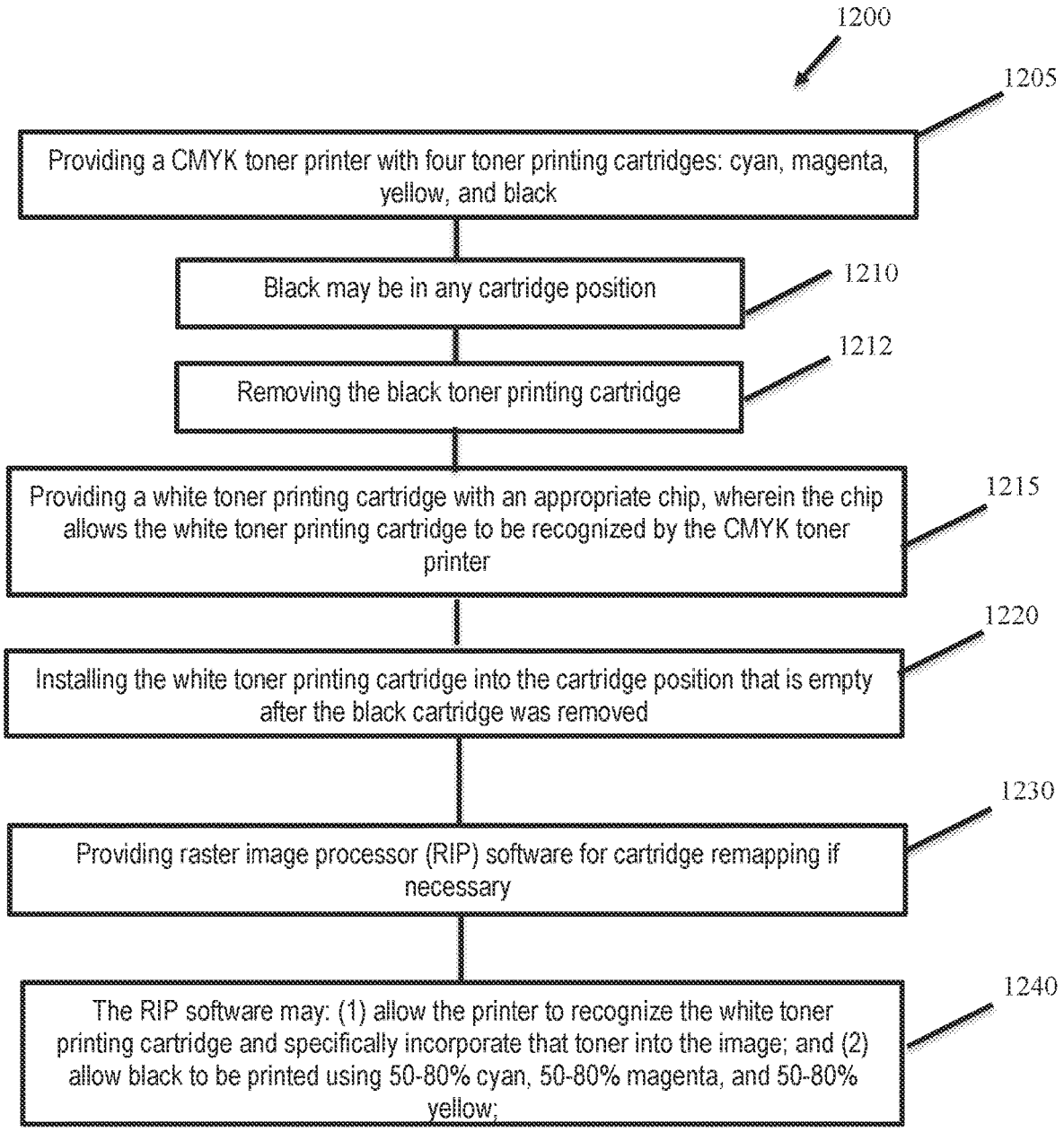
FIG. 6 is a flow block diagram of one embodiment of the method of converting a standard CMYK toner printer to a CMYW toner with a single cartridge conversion.

FIG. 6 is a flow block diagram of one embodiment of the method of converting a standard CMYK toner printer to a CMYW toner with a single cartridge conversion. FIG. 6 shows that the method 1200 may comprise the steps: providing a CMYK toner printer with four toner printing cartridges, cyan (C), magenta (M), yellow (Y), and black (K) 1205; the cartridges may be in any order and the black cartridge may be in any position 1210; removing the black toner printing cartridge 1212; providing a white toner printing cartridge with an appropriate chip, wherein the chip allows the white toner printing cartridge to be recognized by the CMYK toner printer 1215; installing the white toner printing cartridge into the cartridge position that is empty after the black cartridge was removed 1220; providing raster image processor (RIP) software for cartridge remapping if necessary 1230; the RIP software may: (1) allow the printer to recognize the white toner printing cartridge and specifically incorporate that toner into the image; and (2) allow black to be printed using cyan, magenta, and yellow 1240 (the amount of each may be set or determined by RIP; usually 50-80% of each color is used to create a rich black). The white toner may have a chip that allows the printer to recognize that the non-standard toner has replaced the black cartridge, so that RIP software may automatically set black to print using of each of the color toners and automatically recognize what non-standard color has been put into the printer to replace the black toner cartridge. In other embodiments, the user may manually enter into the RIP software that the white toner was inserted into the printer. The RIP software is configured to allow the printer to print images that incorporate the white toner. In some embodiments, the user may move around the three color toners after taking out the black toner. The white toner is then inserted into the empty slot and the RIP software is used to remap the printer.

Figure 7:
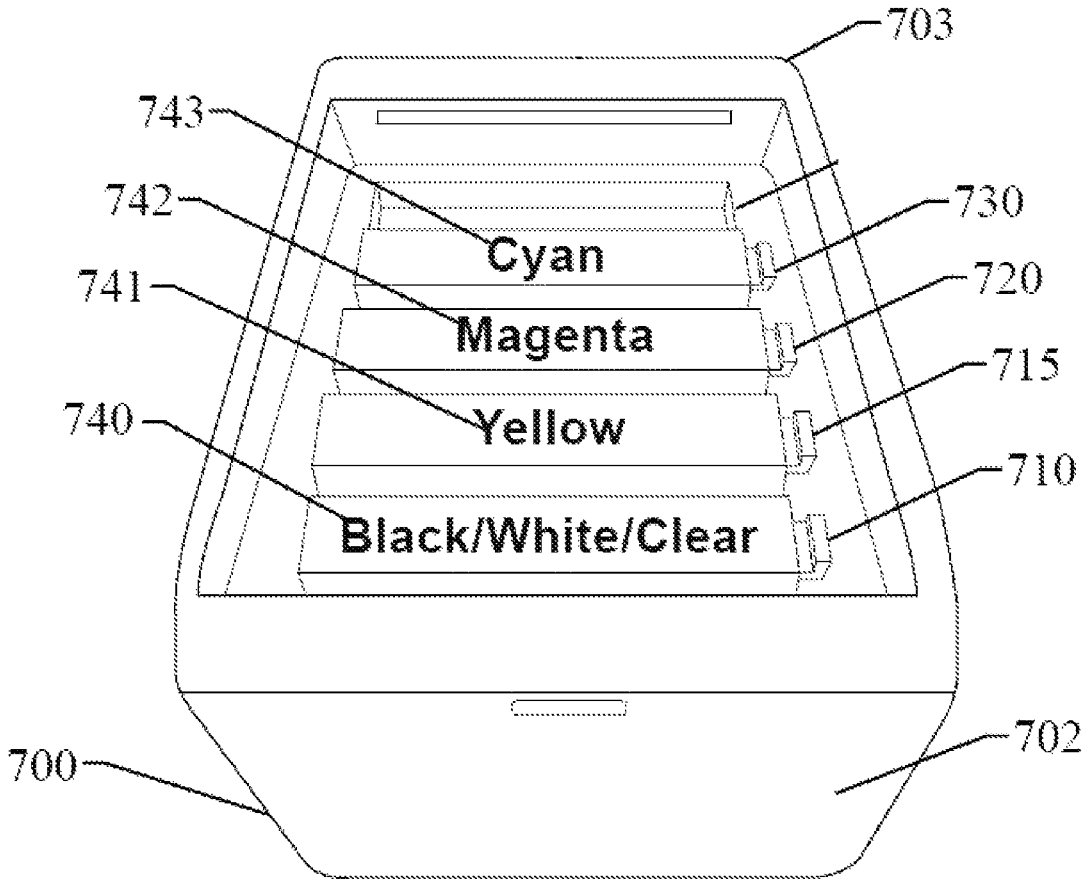
FIG. 7 is an illustration of one embodiment of a printer.
Figure 8:
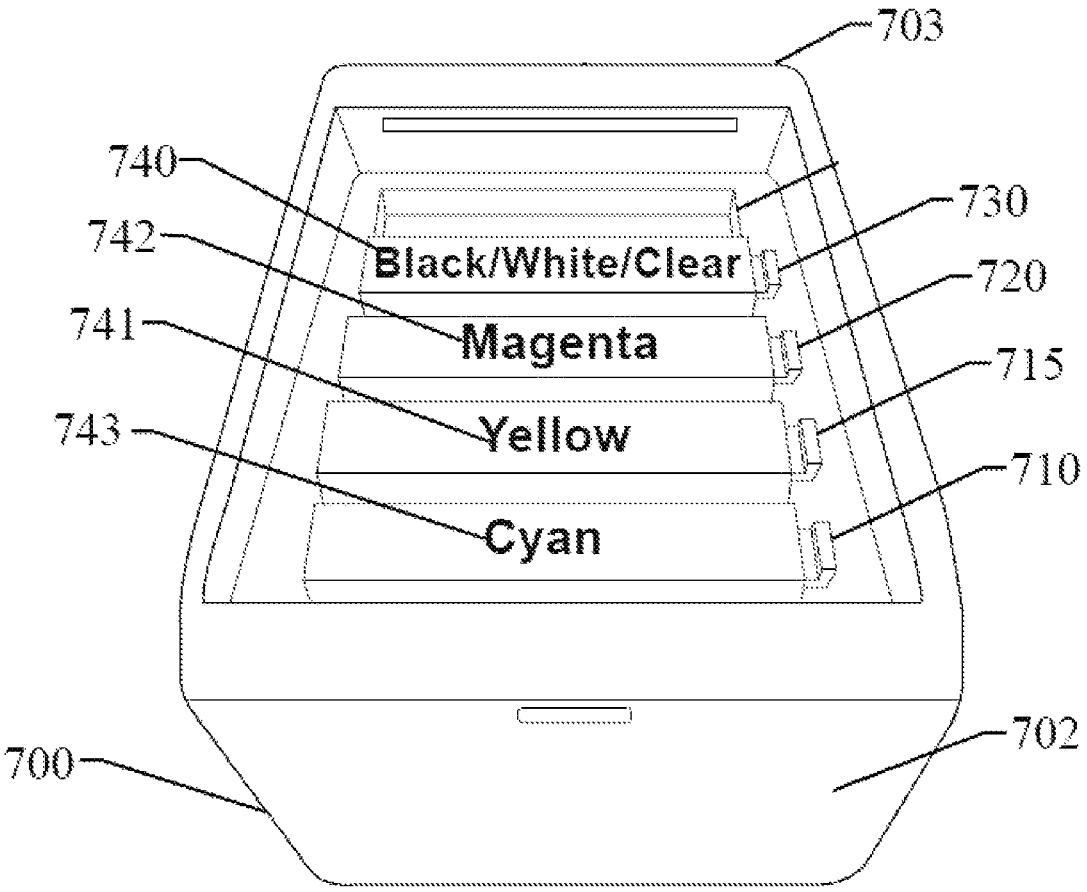
FIG. 8 is an illustration of another embodiment of a printer.

FIG. 7 is an illustration of one embodiment of a CMYW printer 700 with four toner cartridges, white 740, yellow 741, magenta 742, and cyan 743, which are in, respectively, cartridge slots 710, 715, 720, and 730. One or more of the cartridges 740, 741, 742, 743 may be removed and another cartridge may be swapped in, such as black or clear (which is an X cartridge). FIG. 7 shows that the white 740 cartridge may start (or end up in) the first slot at the front 702 of the printer 700. FIG. 8 shows the white 740 may start (or end up in) the last slot at the rear 703 of the printer 700.

FIG. 8 is an illustration of another embodiment of a CMYW printer 700 with four toner cartridges, white 740, magenta 742, yellow 741, and cyan 743, which are in, respectively, cartridge slots 730, 720, 715, and 710. One or more of the cartridges 740, 741, 742, 743 may be removed and another cartridge may be swapped in, such as black or clear (which is an X cartridge). FIG. 8 shows the white 740 may start (or end up in) the last slot at the rear 703 of the printer 700.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a CMYK toner printer to print with a non-standard toner, comprising the steps:

providing a CMYK toner printer;

wherein said CMYK toner printer has four printing cartridges;

wherein said four printing cartridges comprise a black toner printing cartridge, a cyan toner printing cartridge, a magenta toner printing cartridge, and a yellow toner printing cartridge;

removing said black toner printing cartridge from said CMYK toner printer, such that there is an empty toner cartridge slot;

providing a non-standard toner printing cartridge that is filled with a non-standard toner;

installing said non-standard toner printing cartridge into said empty toner cartridge slot;

wherein said non-standard tonner printing cartridge is selected from the group of non-standard toner printing cartridges consisting of white, clear, and clear fluorescent; and providing raster image processor (RIP) software, such that said CMYK toner printer is configured to incorporate said non-standard toner into one or more images printed by said CMYK toner printer in a single pass, such that all of said one or more images printed are not loaded into said CMYK toner printer again.

2. The method of claim 1, wherein said RIP software allows for remapping of said CMYK toner printer.

3. The method of claim 1, wherein said RIP software allows black to be printed using a combination of cyan, magenta, and yellow.

4. The method of claim 1, wherein said non-standard toner printing cartridge is selected from the group of non-standard toner printing cartridges consisting of: white; clear; clear fluorescent; ceramic; sublimation; and security.

5. The method of claim 1, wherein said CMYK toner printer is a laser toner printer.

6. The method of claim 1, wherein said CMYK toner printer is a LED toner printer.

7. A method of converting a CMYK toner printer to print with a white toner, comprising the steps:

providing a CMYK toner printer;

wherein said CMYK toner printer has four printing cartridges;

wherein said four printing cartridges comprise a black toner printing cartridge, a cyan toner printing cartridge, a magenta toner printing cartridge, and a yellow toner printing cartridge;

removing said black toner printing cartridge from said CMYK toner printer, such that there is an empty toner cartridge slot;

providing a white toner printing cartridge that is filled with a white toner;

installing said white toner printing cartridge into said empty toner cartridge slot; and providing raster image processor (RIP) software, such that said CMYK toner printer is configured to incorporate said white toner into one or more images printed by said CMYK toner printer in a single pass, such that all of said one or more images printed are not loaded into said CMYK toner printer again.

8. The method of claim 7, wherein said RIP software allows for remapping of said CMYK toner printer.

9. The method of claim 7, wherein said RIP software allows black to be printed using a combination of cyan, magenta, and yellow.

10. The method of claim 7, wherein said CMYK toner printer is a laser toner printer.

11. The method of claim 7, wherein said CMYK toner printer is a LED toner printer.

* * * * *